US005547354A

United States Patent [19]

Shimizu et al.

[11] Patent Number: 5,547,354

[45] Date of Patent: Aug. 20, 1996

[54] SCROLL COMPRESSOR BALANCING

[75] Inventors: Izuru Shimizu; Tetsuhiko Fukanuma; Tetsuya Yamaguchi; Kunifumi Goto; Shigeru Hisanaga; Hirotaka Egami, all of Kariya, Japan

[73] Assignees: Kabushiki Kaisha Toyoda Jidoshokki Seisakusho; Nippondenso Co., Ltd., both of Kariya, Japan

[21] Appl. No.: 347,965

[22] Filed: Dec. 1, 1994

[30] Foreign Application Priority Data

Dec. 2, 1993 [JP] Japan ..... 5-303124

[51] Int. Cl.[6] ..... F04C 18/04

[52] U.S. Cl. ..... 418/55.5; 418/57; 418/151

[58] Field of Search ..... 418/55.5, 57, 151

[56] References Cited

U.S. PATENT DOCUMENTS

| | | | |
|---|---|---|---|
| 4,735,559 | 4/1988 | Morishita et al. | 418/151 |
| 4,824,346 | 4/1989 | Hiraga et al. | 418/57 |
| 4,934,910 | 6/1990 | Utter | 418/55.5 |
| 5,199,862 | 4/1993 | Kondo et al. | 418/151 |

FOREIGN PATENT DOCUMENTS

| | | | |
|---|---|---|---|
| 0078148 | 5/1983 | European Pat. Off. . | |
| 0422311 | 4/1991 | European Pat. Off. . | |
| 0468605 | 1/1992 | European Pat. Off. . | |
| 0489479 | 6/1992 | European Pat. Off. . | |
| 4305876 | 9/1993 | Germany . | |
| 59-110887 | 6/1984 | Japan . | |
| 2176179 | 7/1990 | Japan . | |
| 4321785 | 11/1992 | Japan | 418/151 |
| 5302578 | 11/1993 | Japan | 418/151 |

*Primary Examiner*—John J. Vrablik

*Attorney, Agent, or Firm*—Brooks Haidt Haffner & Delahunty

[57] ABSTRACT

A compressor has a movable scroll supported on a bushing connected to a rotary shaft via an eccentric pin. The movable scroll and the bushing are disposed coaxial to the eccentric pin to rotate together with the eccentric pin. The movable scroll moves along a predetermined circular path around an axis of the rotary shaft to closely contact a fixed scroll, opposed to the movable scroll at a given portion to define a displaceable fluid pocket and compresses refrigerant gas introduced into the fluid pocket. The compressor comprises a first balance weight eccentrically supported on the eccentric pin for an integral rotation therewith. The first balance weight is arranged to generate first centrifugal force counteracting second centrifugal force generated in the movable scroll and the bushing based on the rotation of the movable scroll and the bushing. The first balance weight has a weight in a predetermined ratio to weights of the movable scroll and the bushing to cancel substantially 80 to 97 percents of the second centrifugal force with the first centrifugal force. Thus, the movable scroll is kept to move along the predetermined circular path.

17 Claims, 9 Drawing Sheets

SCROLL COMPRESSOR BALANCING

BACKGROUND OF THE INVENTION

1. Field of the Invention

The present invention relates to a scroll type compressor for use in a vehicle's air conditioning system. More particularly, this invention relates to a mechanism for maintaining the dynamic balance of a movable scroll and its associated members while a compressor is running.

2. Description of the Related Art

Generally speaking, the operation of a scroll type compressor uses the revolving movement of a movable scroll angularly interfit with a fixed scroll inside the housing of the compressor to compress refrigerant gas. Each of the fixed and movable scrolls has a spiral element and a fixed end plate. When interfit with each other, the two scrolls form gas pockets. When the movable scroll revolves relative to the fixed scroll, the pockets spiral with decreasing volume toward the center of the scrolls, thereby compressing the refrigerant gas.

Operational power is transmitted to such compressors via a rotary shaft supported by a bearing in the front of the compressor housing. An eccentric pin, attached to the end of the rotary shaft, projects into the front end of the compressor housing. A boss, formed on the front face of the movable scroll's end plate, fits over the eccentric pin via a bushing and a bearing. This allows the movable scroll to rotate relative to the eccentric pin.

An anti-rotation device, between the movable scroll and pressure receiving wall of the housing on the fixed scroll side, inhibits the movable scroll's rotation. The anti-rotation device does however allow the movable scroll to revolve around the axis of the rotary shaft. A balance weight, attached to the eccentric pin, dynamically balances the rotary shaft and movable scroll against the centrifugal forces produced by the revolving movable scroll.

In conventional compressors, both the balance weight and the revolving movable scroll generate centrifugal forces which tend to oppose each other. In addition to these two forces, a compressive reactive force is generated on the movable scroll, during the compressor's gas compression stroke. This reactive force, in general, is not canceled by the centrifugal force set up by the balance weight. Consequently, the reactive force tends to be absorbed by the eccentric pin, the bearing and other structures supporting the movable scroll and contributes to their deterioration.

The actual weight of the balance weight also affects the compressor's performance. Acceptable design tolerances of the balance weight requires its weight to fall within three percent of the combined weight of the movable scroll and bushing weight. This is important since the weight of these components directly effects the centrifugal force produced by the movable scroll. Should the weight of the balance weight cause an increase in the centrifugal force, even by as little as 2%, the outer wall of the movable scroll's spiral element tends to separate from the inner wall of the fixed scroll during the movable scroll's revolution. This impairs the efficiency with which the gas pockets are sealed, reduces the compressor's efficiency and raises the temperature of the refrigerant gas.

A further disadvantage of conventional balance weights is their size. Large heavy balance weights inevitably require compressor housings with increased volumetric capacities.

This, unfortunately, precludes the design of compact sized compressors.

SUMMARY OF THE INVENTION

Accordingly, it is a primary object of the present invention to provide a scroll type compressor which reduces the load of a balance weight on the eccentric pin attached to the compressor's rotary shaft to thereby improve the durabilities of the eccentric pin and a bearing supporting the rotary shaft It is another object of this invention to provide a compressor wherein the gas pockets formed between the spiral elements remain effectively sealed even under a high-speed rotation, thereby improving the compression efficiency.

It is a further object of this invention to provide a compressor which can use a lighter balance weight allowing for a reduction in the overall weight of the compressor.

To achieve the foregoing and other objects and in accordance with the purpose of the present invention, there is provided a compressor having a movable scroll supported on a bushing connected to a rotary shaft via an eccentric pin. The movable scroll and the bushing are disposed coaxial to the eccentric pin to rotate together with the eccentric pin. The movable scroll moves along a predetermined circular path around an axis of the rotary shaft to closely contact a fixed scroll, opposed to the movable scroll at a given portion to define a displaceable fluid pocket and compresses refrigerant gas introduced into the fluid pocket. The compressor comprises a first balance weight eccentrically supported on the eccentric pin for an integral rotation therewith. The first balance weight is arranged to generate first centrifugal force counteracting second centrifugal force generated in the movable scroll and the bushing based on the rotation of the movable scroll and the bushing. The first balance weight has a weight in a predetermined ratio to weights of the movable scroll and the bushing to cancel substantially 80 to 97 percents of the second centrifugal force with the first centrifugal force. Thus, the movable scroll is kept to move along the predetermined circular path.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of the present invention will now be described referring to FIGS. 1 through 7.

Figure 5:
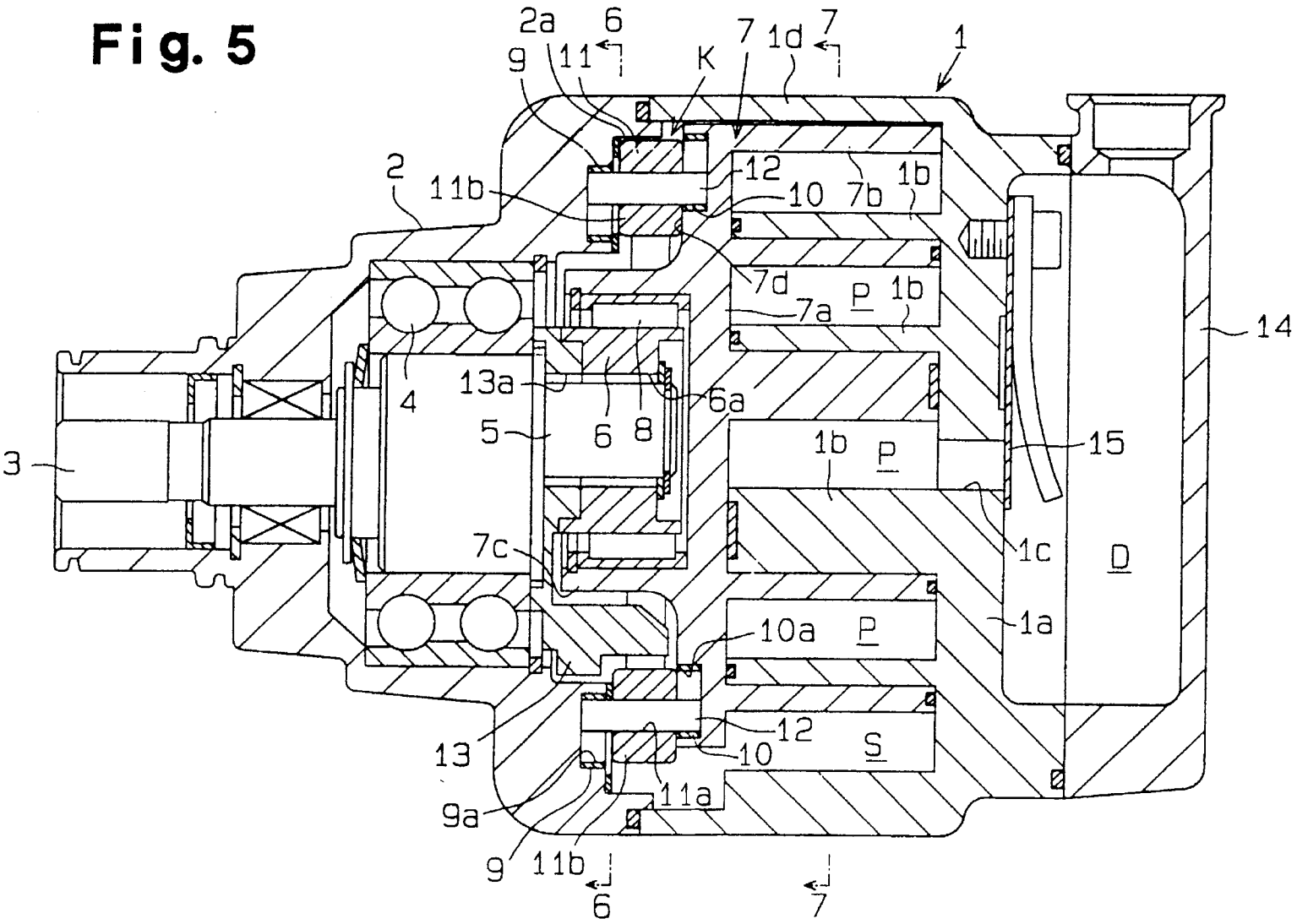
FIG. 5 is a vertical cross-sectional view showing the overall compressor in FIG. 1.

As shown in FIG. 5, a fixed scroll 1 serves as the compressor's center housing 1*d* and connects to a front housing 2. A bearing 4 rotatably supports a rotary shaft 3, in the front housing 2. The rotary shaft 3 securely attaches to an eccentric pin 5, here shaped in the form of a rectangular prism.

Figure 7:
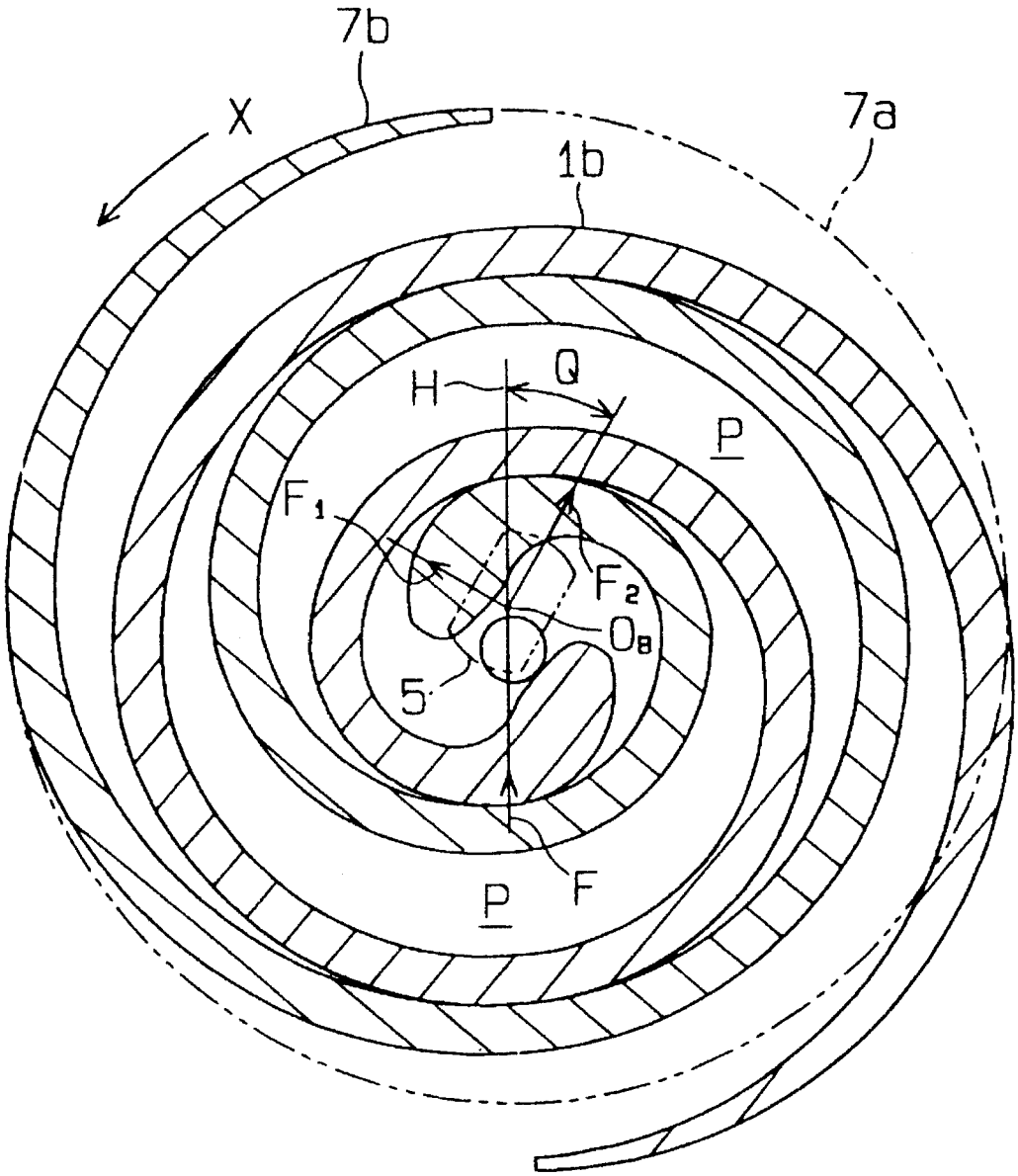
FIG. 7 is a cross-sectional view taken along the line 7—7 in FIG. 5, showing two scrolls.

A balance weight 13 and a bushing 6 are attached to the eccentric pin 5. The bushing 6 has a nearly rectangular cylinder hole 6*a* fitted over the eccentric pin 5. A movable scroll 7 which engages with the fixed scroll 1 is rotatably supported by the bushing 6 via a radial bearing 8. The fixed scroll 1 has an end plate 1*a* and a spiral element 1*b* formed integral with the end plate 1*a*. Likewise, the movable scroll 7 has an end plate 7*a* and a spiral element 7*b* integrally formed with the end plate 7*a*. The bushing 6 fits into a boss portion 7*c* integrally formed on the front face of the movable end plate 7*a*. A plurality of gas pockets P are formed between the end plates 1*a* and 7*a* and the associated spiral elements 1*b* and 7*b*. The volume of gas contained in each pocket P decreases as the pocket shifts toward the center from the periphery of the movable scroll 7, as shown in FIG. 7.

The front face of the movable end plate 7*a* forms a movable pressure receiving wall 7*d*. A fixed pressure receiving wall 2*a* is formed on the inner wall of the front housing 2. An anti-rotation device K intervenes between both pressure receiving walls 2*a* and 7*d*. This device K prevents the movable scroll 7 from rotating about its own axis. Device K, nonetheless, permits the orbital movement or revolution of the movable scroll 7 about the axis of the rotary shaft 3.

More specifically, this anti-rotation device K has a plurality of cylindrical collars 9 (four in this embodiment) which are fitted in the fixed pressure receiving wall 2*a*. Device K also has a plurality of cylindrical collars 10 fitted in the front face of the movable end plate 7*a*, eccentrically displaced at predetermined distances from the associated collars 9. A ring 11 is disposed between both pressure receiving walls 2*a* and 7*d*. Formed in the ring 11 are a plurality of through holes 11*a* (four in this embodiment) in which pins 12 are respectively inserted. Each pin 12 is engaged with the inner walls of a hole 9*a* of the associated collar 9 and a hole 10*a* of the associated collar 10.

As the rotary shaft 3 rotates, the eccentric pin 5 and the bushing 6 revolve. The engagement of each pin 12 with the associated holes 9*a* and 10*a* prevent the movable scroll 7 from rotating around its own axis, but allow it to revolve around the axis of the rotary shaft 3. Four elements 11*b* are formed integral with the front and rear faces of the ring 11. These elements are spaced at equal angular distances to transmit the compressive reaction force of the refrigerant gas to the fixed pressure receiving wall 2*a* from the movable pressure receiving wall 7*d*.

A suction port (not shown) is formed in the front housing 2, and a suction chamber S is formed between the movable scroll 7 and the inner wall of the front housing 2. A rear housing 14 in which a discharge chamber D is formed is securely joined to the rear face of the fixed scroll 1. A discharge hole 1*c* is formed in the fixed end plate 1*a*, and a discharge valve 15 for opening and closing the discharge hole 1*c* is disposed in the discharge chamber D.

The function of the scroll type compressor having the above-described structure will now be described.

When the rotary shaft 3 rotates, rotation of the movable scroll 7 is inhibited by the anti-rotation device K. The movable scroll 7 does, however, revolve together with the eccentric pin 5 around the axis of the rotary shaft 3. Refrigerant gas is then supplied into the suction chamber S from the suction port and flows into the pockets P between both scrolls 1 and 7. As the movable scroll 7 revolves, the pockets P converge toward the center of both spiral elements 1*b* and 7*b*. During this convergence, the volume of each pocket P decreases. As a result, the refrigerant gas is compressed in each pocket P and is discharged to the discharge chamber D from the discharge hole 1*c*.

Figure 6:
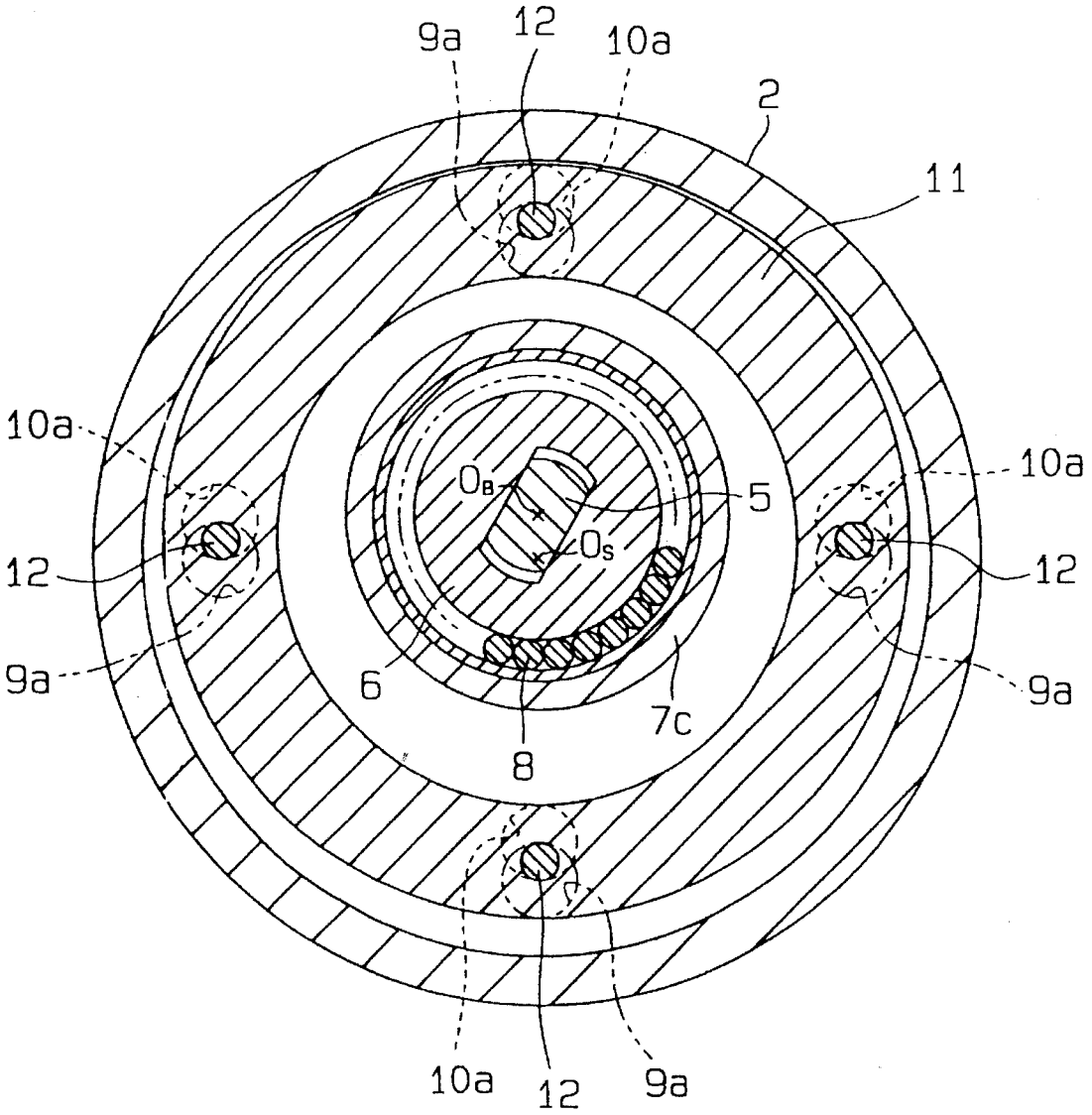
FIG. 6 is a cross-sectional view taken along the line 6—6 in FIG. 5.

The operation of the anti-rotation device K will now be described with reference to FIG. 6. Each pin 12 engages both the fixed and movable scrolls. A front end of each pin 12 engages the uppermost portion of the hole 9*a* of the associated collar 9, while the rear end of each pin 12 is engaged with the lowermost portion of the hole 10*a* of the associated collar 10. The movement of each pin 12 is therefore restricted by the inner walls of the associated pair of opposing collars 9 and 10. As shown in FIG. 6, at the beginning of a revolution, the bushing 6, the movable scroll 7 and axis $O_R$ are located at an uppermost position in their revolution with respect to axis $O_S$.

When the eccentric pin 5 and bushing 6 rotate counterclockwise due to the rotation of rotary shaft 3, the center axis $O_S$ of the bushing 6 moves to the lowest position of the movable scroll's revolution. At this time, each pin 12 moves along the inner walls of the holes 9*a* and 10*a* of the associated collars 9 and 10, maintaining their engagement with the holes 9*a* and 10*a*. Though not illustrated, the front end of each pin 12 engages with the lowermost end of the hole 9*a* of the associated collar 9 on the fixed side, and the rear end of each pin 12 engages with the uppermost end of the hole 10*a* of the associated collar 10 on the movable side. Therefore, the engagement of each pin 12 with the associated collars 9 and 10 allows the movable scroll 7 to revolve with a radius of revolution corresponding to the distance, R, between the axes $O_S$ and $O_B$. This is illustrated, for example, in FIG. 3.

The balance weight 13 will now be discussed in detail.

Figure 1:
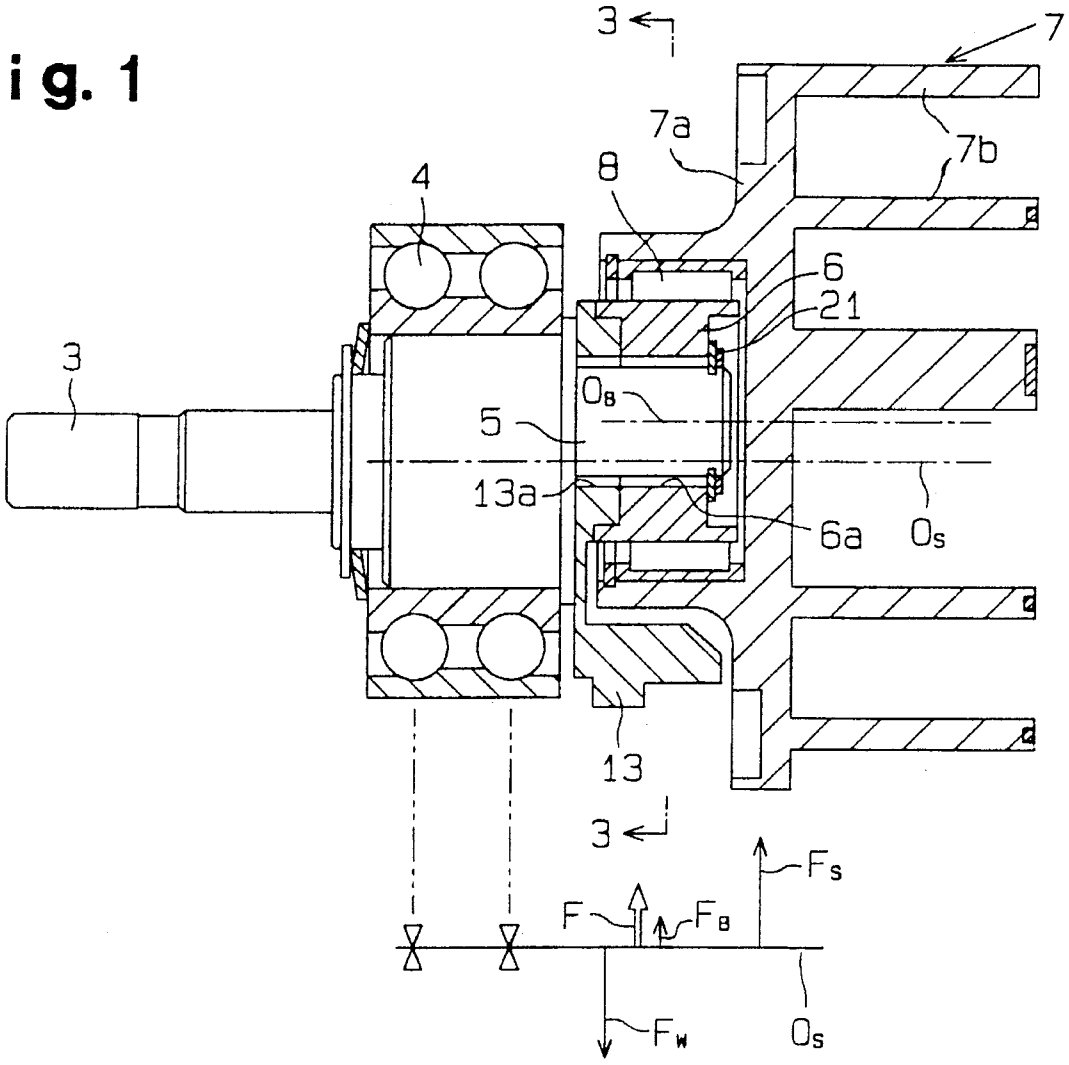
FIG. 1 is a vertical cross-sectional view showing the essential portions of a compressor according to a first embodiment of the present invention.

The balance weight 13, shown in FIGS. 1 and 5, has an elongated hole 13*a* where the eccentric pin 5 is inserted. With this pin 5 inserted in the hole 13*a*, therefore, the balance weight 13 is rotatable together with the pin 5. The eccentric pin 5 has a pair of guide surfaces 5*a* on both sides, extending in parallel to the axis of the rotary shaft 3. The elongated hole 13*a* and the elongated hole 6*a* of the bushing 6 are set longer than the cross sectional length of the eccentric pin 5, i.e., the short side of the guide surface 5*a*.

Figure 2:
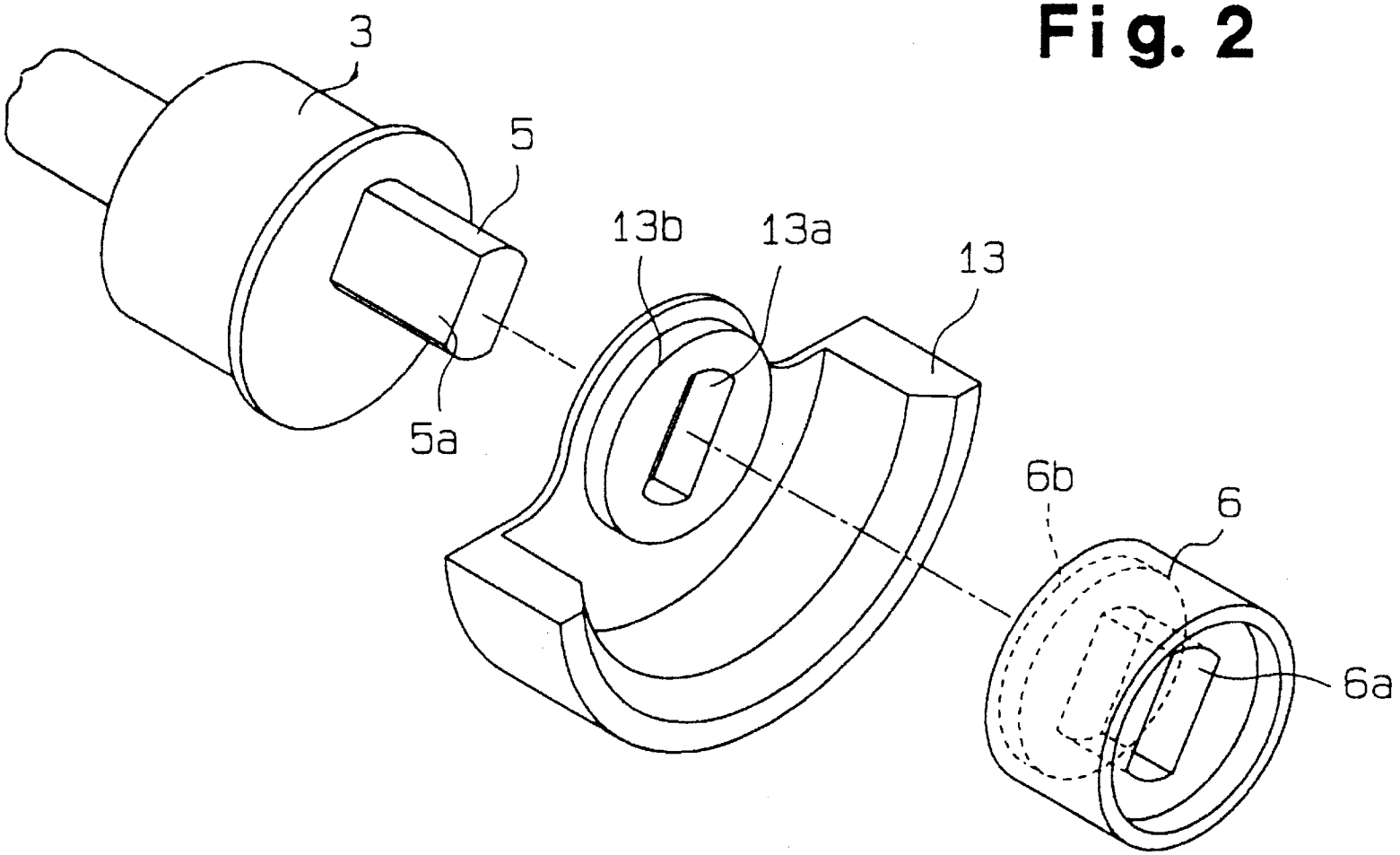
FIG. 2 is an exploded perspective view showing the rotary shaft, balance weight and bushing of the compressor shown in FIG. 1.

Therefore, the bushing 6 and the balance weight 13 can move slightly in the radial direction along the guide surfaces 5*a* of the eccentric pin 5. A shallow recess 6*b* is formed in the front end face of the bushing 6 as shown in FIG. 2. A projection 13*b* is formed on the center portion of the balance weight 13, and is fittable in the recess 6*b* to prevent the radial deviation of the projection 13*b* and the recess 6*b*.

In this embodiment, the weights of the movable scroll 7 and the balance weight 13 are set in such a way that the centrifugal force $F_W$ produced by the revolution of the balance weight 13 is 80 to 97% of the sum of the centrifugal forces $F_S$ and $F_B$ respectively produced by the revolution of the movable scroll 7 and the bushing 6. The guide surfaces 5*a* of the eccentric pin 5 are inclined at an angle θ with respect to a straight line H passing through the center axis $O_S$ of the rotary shaft 3 and the center axis $O_B$ of the bushing 6 as shown in FIG. 3.

Figure 3:
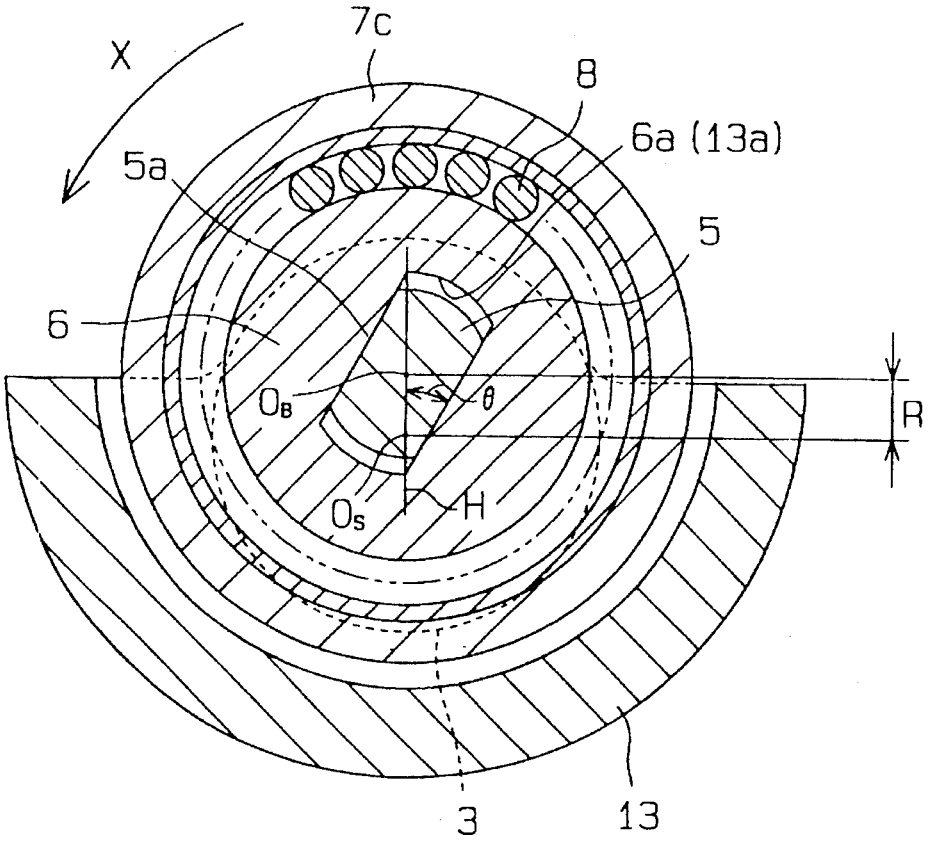
FIG. 3 is a cross-sectional view taken along the line 3—3 in FIG. 1.

At the time the eccentric pin 5 revolves, the balance weight 13 revolves together with the movable scroll 7 in the direction X, as shown in FIG. 3, via the bushing 6. Since the sum of the centrifugal force $F_S$ of the movable scroll 7 and the centrifugal force $F_B$ of the bushing 6 is set greater than the centrifugal force $F_W$ of the balance weight 13, the guide surface 5*a* of eccentric pin 5 guides the movable scroll 7 and bushing 6 to move with an increasing radius of revolution R, as shown in FIG. 1. Consequently, the spiral element 7*b* of the movable scroll 7 is tightly pressed against the spiral element 1*b* of the fixed scroll 1, thus improving the sealing of the pockets P.

Figure 4:
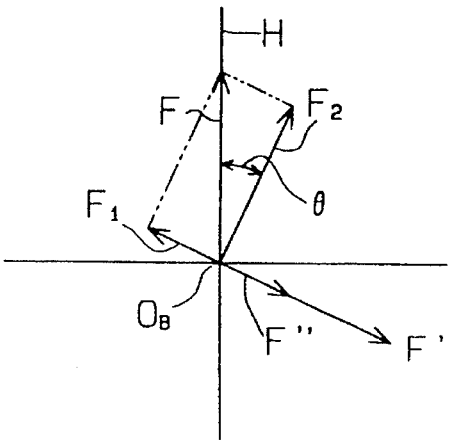
FIG. 4 is an vector diagram illustrating the forces acting on the center of the bushing.

The above will be discussed more specifically. During the compressor's operation, the centrifugal force $F_W$ acts on the balance weight 13, the centrifugal force $F_B$ acts on the bushing 6, and the centrifugal force $F_S$ acts on the movable scroll 7, as shown in FIG. 1. Those centrifugal forces $F_W$, $F_B$ and $F_S$ can be expressed as a combined force F ($=F_W+F_B+F_S$) along the line H, as shown in FIG. 4. This combined force F consists of two component forces $F_1$ and $F_2$. The first component force $F_1$ ($=F\times\cos\theta$) acts on the eccentric pin 5 itself in the direction perpendicular to the inclined surfaces 5*a* of the eccentric pin 5. The second component force $F_2$ ($=F\times\sin\theta$) acts on the bushing 6 and the movable scroll 7 in the direction parallel to the inclined surfaces 5*a*, pressing the spiral element 7*b* of the movable scroll 7 against the spiral element 1*b* of the fixed scroll 1. Therefore, the second component force $F_2$ improves the sealing of the pockets P, and consequently, the efficiency with which the compressor can compress refrigerant gas.

A description will now be given of the relationship between the centrifugal forces and the compressive reaction force of the refrigerant gas. The compressive reaction force F' of the refrigerant gas acts on the eccentric pin 5 in the direction opposing the direction of the first component force $F_1$ as shown in FIG. 4. Practically, therefore, a bending load F" ($=F'-F_1$) acts on the eccentric pin 5. This bending load F" is smaller than the compressive reaction force F' (F"<F'). should the sum of the movable scroll's centrifugal force and the bushing's centrifugal force be unbalanced with the balance weight's centrifugal force, the bending load F" will be reduced if the centrifugal force $F_w$ lies within 80 to 97% of the sum of the movable scroll's centrifugal force $F_3$ and the bushing's centrifugal force $F_B$. While the magnitudes of the compressive reaction force F' and the first component force $F_1$ may vary, depending on the number of rotations of the compressor, the compression ratio, etc., the directions of these forces F' and $F_1$ will not.

If the centrifugal force $F_W$ of the balance weight 13 is less than 80% of the sum of the movable scroll's centrifugal force $F_s$ and the bushing's centrifugal force $F_s$, the intended performance of the balance weight 13 will be less than desirable. On the other hand, should the centrifugal forces $F_w$ exceed 97% of the sum of the movable scroll's centrifugal force $F_S$ and the bushing's centrifugal force $F_S$, then the centrifugal force $F_W$ will be excessively large in comparison to the sum of the centrifugal forces $F_S$ and $F_B$. This is due to the influence of the weight of the movable scroll 7, the balance weight 13 and variations in manufacturing tolerances of the various component sizes. Consequently, this reduces the effectiveness with which the gas pockets can be sealed, and prevents reductions from being made to the bending load F" on the eccentric pin 5.

Figure 8:
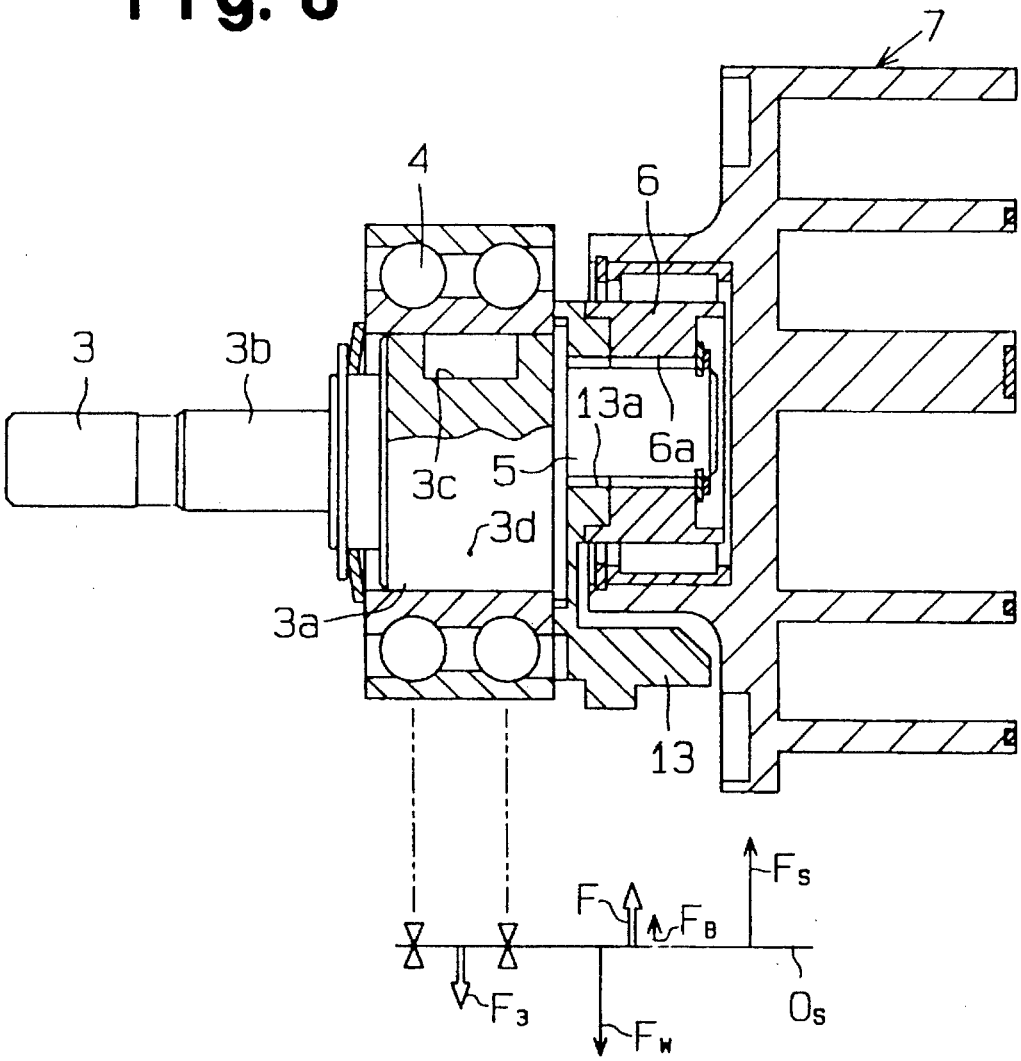
FIG. 8 is a vertical cross-sectional view showing the essential portions of a compressor according to a second embodiment of this invention.

A second embodiment of the present invention will be described below with reference to FIG. 8.

As mentioned earlier, the combined force F of the centrifugal force $F_W$ of the balance weight 13, the centrifugal force $F_B$ of the bushing 6 and the centrifugal force $F_S$ of the movable scroll 7 acts on the eccentric pin 5. This combined force F is transmitted via the eccentric pin 5 to the rotary shaft 3. In this embodiment, a recess 3*c* is provided at the outer surface of the large diameter portion 3*a*, of the rotary shaft 3. A second balance weight 3*d* helps to prevent rotary shaft 3 from being dynamically unbalanced by the balance weight 13 and the movable scroll 7. To form the second balance weight 3*d*, a recess 3*c* needs to be formed on the large diameter portion 3*a*.

The rotary shaft 3 can be formed by forging or molding, and the inner wall of the recess 3*c* may be left as a forged surface. In this case, the recess 3*c* can be formed without carrying out unnecessary post working. The reduced number of steps needed to manufacture the compressor, as well as improving the yield of manufacturing materials, contributes to reduce the overall cost of the compressor.

According to the second embodiment, any deficiency in the centrifugal force $F_W$ produced by the balance weight 13 can be compensated by centrifugal force $F_3$ produced by the balance weight portion 3*d* of the rotary shaft 3. This allows the rotary shaft 3 to rotate smoothly, reducing the load on the radial bearing 4, thereby increasing its durability.

Figure 9:
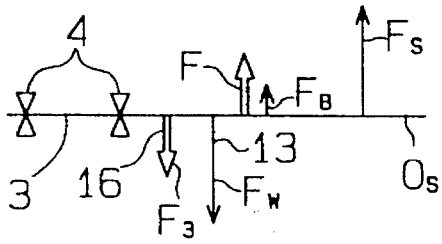
FIG. 9 is an explanatory diagram of a modification of the second embodiment.

A modification of the second embodiment will be briefly described below with reference to FIG. 9.

In this modification, a second balance weight 16 is disposed between the radial bearing 4 and the balance weight 13 in place of the recess 3*c* and balance weight portion 3*d* of the rotary shaft 3. It is therefore possible to counteract the combined force F acting on the rotary shaft 3 with the second balance weight 16, allowing smooth rotation of the rotary shaft 3.

A third embodiment of the present invention will be described below with reference to FIG. 10.

In this embodiment, a recess 103*c* in the rotary shaft 3 is formed deeper than the recess 3*c* in the second embodiment. Accordingly, centrifugal force $F_{3a}$ greater than the centrifugal force $F_3$ described in the second embodiment is generated on a balance weight portion 103*d*. In order to generate a centrifugal force $F_{17}$ opposite to the direction of the centrifugal force $F_{3a}$, a third balance weight 17 is secured to the small diameter portion 3*b* of the rotary shaft 3 by welding, adhesion or other similar procedure.

Next, the combined force F is set equal to the centrifugal force $F_{17}$, while the centrifugal force $F_{3a}$, produced by the balance weight portion 3*d*, is set twice as large as the combined force F. Further, the distance between the application of the combined force F and the centrifugal force $F_{3a}$ is set equal to the distance between the application of both centrifugal forces $F_{3a}$ and $F_{17}$.

According to the third embodiment, therefore, the combined force F and the centrifugal forces $F_{3a}$ and $F_{17}$ are completely counteracted and the rotary shaft 3 rotates smoothly, thus preventing excessive loads from affecting the radial bearing 4.

The present invention is not limited to the above-described embodiments, and may be embodied in the following forms.

Figure 11:
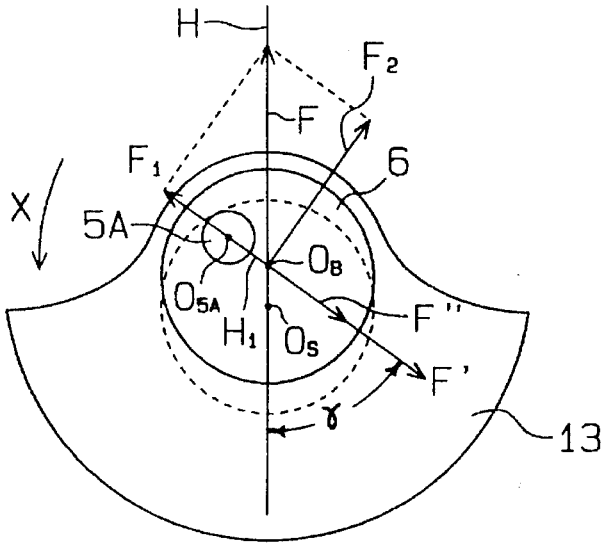
FIG. 11 is a front view showing the essential portions of a compressor according to another modification of this invention.
Figure 12:
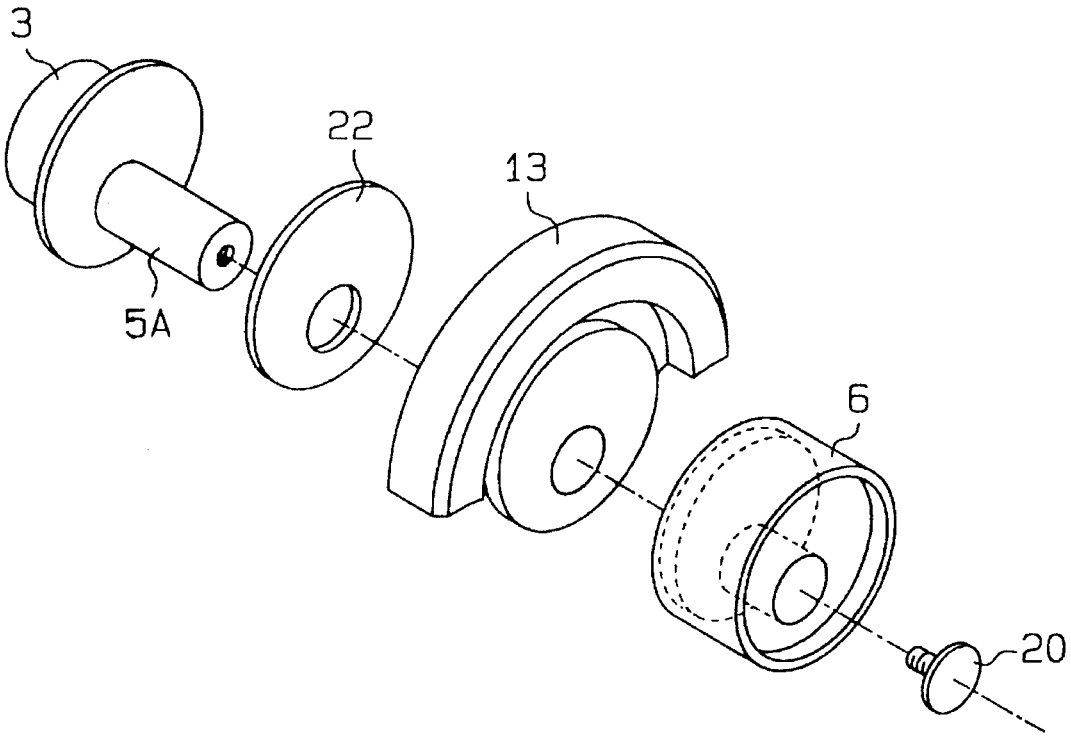
FIG. 12 is an exploded perspective view showing the essential portions of the compressor of FIG. 11.

(1) A circular eccentric pin 5A as shown in FIGS. 11 and 12 may be used in place of the eccentric pin 5 having the shape of a nearly rectangular prism. In this embodiment the bushing 6 and the balance weight 13 are pivotable about the pin 5A. In this case, the angle between a line $H_1$ connecting the center $O_{5A}$ of the eccentric pin 5A to the center $O_2$ of the bushing 6 and the aforementioned line H is expressed by $\gamma$. The combined force F on the line H consists of a first component force $F_1$ and the second component force $F_2$ both of which are determined according to the angle $\gamma$. The compressive reaction force F' is similar to those in the above-described embodiments, and acts on the line $H_1$ in the direction opposite to that of the first component force $F_1$, thereby reducing the bending load F" acting on the eccentric pin 5A. The second component force $F_2$ improves the sealing of the pockets P.

(2) Instead of forming the recess 3*c* in the rotary shaft 3, a separate balance weight of a material having a greater specific weight than that of the material for the rotary shaft 3 is inserted in the large diameter portion 3*a*.

(3) A plurality of screw holes (not shown) are formed in the outer surface of the balance weight 13, and the centrifugal force $F_W$ is adjusted by changing the number of screws to be engaged with the screw holes or the material of the screws.

Figure 10:
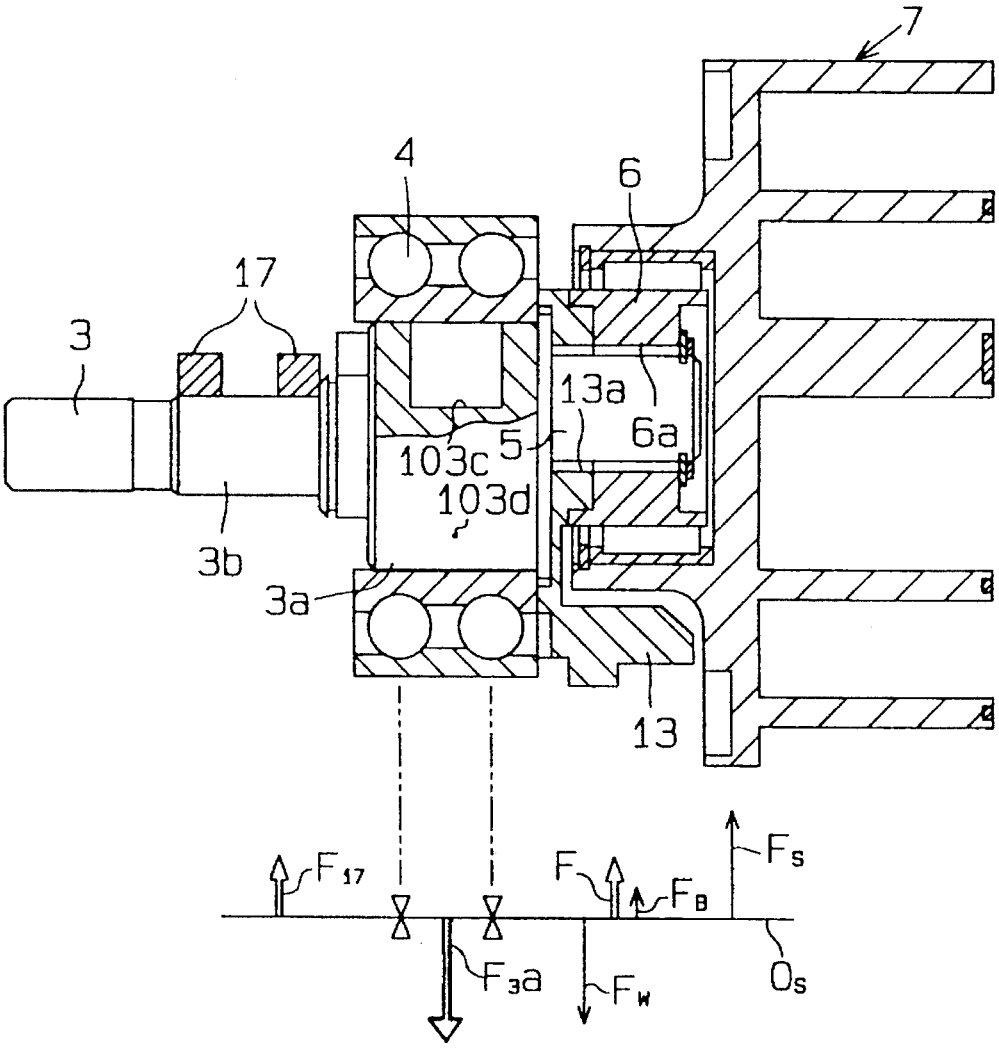
FIG. 10 is a vertical cross-sectional view showing the essential portions of a compressor according to a third embodiment of this invention.

(4) In the embodiment shown in FIG. 10, the weights of the balance weight 13, the balance weight portion 103*d*, the balance weight 17 and the like and the distances between points of action of the individual forces are altered so as to counteract the combined force F, the centrifugal force $F_{3a}$ and the centrifugal force $F_{17}$ as a whole.

What is claimed is:

1. A scroll-type compressor having a fixed scroll, a rotary shaft, a pin joined eccentrically to said rotary shaft, a bushing coupled to said pin, and a movable scroll coupled to said bushing, said scrolls being constructed to define between them a displaceable fluid pocket which, upon rotation of said rotary shaft in a given direction causing said pin, said bushing, and said movable scroll to orbit the longitudinal axis of said rotary shaft, reduces its volume to compress any gas in said pocket, and said bushing and said movable scroll develop a first component of centrifugal force when said rotary shaft is rotated, said compressor further comprising:

a primary balance weight coupled to said bushing eccentric relative to said rotary shaft for creating a second component of centrifugal force for counteracting a portion of said first component of centrifugal force, said primary balance weight being constructed such that said second component of centrifugal force counteracts 80 to 97 percent of said first component of centrifugal force.

2. A compressor according to claim 1, wherein said pin is round in cross section and said bushing is pivotally mounted on said pin.

3. A compressor according to claim 1, wherein said movable scroll is mounted for movement into engagement with said fixed scroll, and, after said counteracting of 80 to 97 percent of said first component of centrifugal force, the residual component of centrifugal force acts to ensure engagement between said movable scroll and said fixed scroll at all rotational speeds of said rotary shaft.

4. A compressor according to claim 1, wherein said bushing and said pin share a common axis which is radially offset from said longitudinal axis of said rotary shaft.

5. A compressor according to claim 4, wherein the longitudinal axis of said rotary shaft and said bushing define an imaginary plane, and the coupling of said movable scroll through said bushing to said rotary shaft is constructed for permitting movement of said movable scroll along a line lying in said imaginary plane.

6. A compressor according to claim 5, wherein said pin has an elongated cross section with a pair of guide surfaces extending parallel to said longitudinal axis of said rotary shaft are inclined with respect to said imaginary plane in a direction opposite to said given direction of rotation of said rotary shaft.

7. A compressor according to claim 1, wherein said first and second components of centrifugal force combine to yield a resultant force which acts on said rotary shaft, and said compressor further comprises a secondary balance weight for counteracting said resultant force for dynamically balancing said shaft.

8. A compressor according to claim 7, further comprising:

an enlarged diameter portion formed on said rotary shaft adjacent to said pin; and a radial bearing supporting said rotary shaft at said enlarged diameter portion;

said secondary balance weight being formed integrally with said large diameter portion.

9. A compressor according to claim 8, further comprising a tertiary balance weight spaced axially from said enlarged diameter portion by a predetermined distance and joined to said rotary shaft for counteracting said resultant force in cooperation with said secondary balance weight for dynamically balancing said shaft.

10. A scroll-type compressor having a fixed scroll, a rotary shaft, a pin joined eccentrically to said rotary shaft, a bushing coupled to said pin sharing a common axis with said pin which common axis is radially offset from the longitudinal axis of said rotary shaft, and a movable scroll coupled to said bushing, said scrolls being constructed to define between them a displaceable fluid pocket which, upon rotation of said rotary shaft in a given direction causing said pin, said bushing, and said movable scroll to orbit said longitudinal axis of said rotary shaft, reduces its volume to compress any gas in said pocket, and said bushing and said movable scroll develop a first component of centrifugal force when said rotary shaft is rotated, wherein:

the longitudinal axes of said rotary shaft and said bushing define an imaginary plane, and the coupling of said movable scroll through said bushing to said rotary shaft is constructed for permitting movement of said movable scroll along a line lying in said imaginary plane;

a primary balance weight coupled to said bushing eccentric relative to said rotary shaft for creating a second component of centrifugal force for counteracting a portion of said first component of centrifugal force, said primary balance weight being constructed such that said second component of centrifugal force counteracts 80 to 97 percent of said first component of centrifugal force.

11. A compressor according to claim 10, wherein said pin has an elongated cross section with a pair of guide surfaces extending parallel to said longitudinal axis of said rotary shaft and inclined with respect to said imaginary plane in a direction opposite to said given direction of rotation of said rotary shaft, and wherein said primary balance weight has a guide hole larger than and similar to said cross section of said pin such that said primary balance weight can move radially with respect to said pin.

12. A compressor according to claim 10, wherein said movable scroll is mounted for movement into engagement with said fixed scroll, and, after said counteracting of 80 to 97 percent of said first component of centrifugal force, the residual component of centrifugal force acts to ensure engagement between said movable scroll and said fixed scroll at all rotational speeds of said rotary shaft.

13. A compressor according to claim 10, wherein said first and second components of centrifugal force combine to yield a resultant force which acts on said rotary shaft, and said compressor further comprises a secondary balance weight for counteracting said resultant force for dynamically balancing said shaft.

14. A compressor according to claim 13, further comprising:

an enlarged diameter portion formed on said rotary shaft adjacent to said pin; and a radial bearing supporting said rotary shaft at said enlarged diameter portion;

said secondary balance weight being formed integrally with said large diameter portion.

15. A compressor according to claim 14, further comprising a tertiary balance weight spaced axially from said enlarged diameter portion by a predetermined distance and joined to said rotary shaft for counteracting said resultant force in cooperation with said secondary balance weight for dynamically balancing said shaft.

16. A scroll-type compressor having a fixed scroll, a rotary shaft, a pin having a circular cross section connected eccentrically to said rotary shaft, a bushing pivotally coupled to said pin, and a movable scroll coupled to said bushing, said scrolls being constructed to define between them a displaceable fluid pocket which, upon rotation of said rotary shaft in a given direction causing said pin, said bushing, and said movable scroll to orbit the longitudinal axis of said rotary shaft, reduces its volume to compress any gas in said pocket, and said bushing and said movable scroll develop a first component of centrifugal force when said rotary shaft is rotated, said compressor further comprising:

a primary balance weight coupled to said bushing eccentric relative to said rotary shaft for creating a second component of centrifugal force for counteracting a portion of said first component of centrifugal force, said primary balance weight being constructed such that said second component of centrifugal force counteracts 80 to 97 percent of said first component of centrifugal force.

17. A compressor according to claim 16, wherein said movable scroll is mounted for movement into engagement with said fixed scroll, and, after said counteracting of 80 to 97 percent of said first component of centrifugal force, the residual component of centrifugal force acts to ensure engagement between said movable scroll and said fixed scroll at all rotational speeds of said rotary shaft.

* * * * *

UNITED STATES PATENT AND TRADEMARK OFFICE

CERTIFICATE OF CORRECTION

PATENT NO. : 5,547,354
DATED : August 20, 1996
INVENTOR(S) : I. Shimizu et al

It is certified that error appears in the above-indentified patent and that said Letters Patent is hereby corrected as shown below:

Column 4, line 39, "$O_R$" should read --$O_B$--;
line 43 "$O_S$" should read --$O_B$--.

Column 5, line 56, "should" should read --Should--;
line 60, "$F_3$" should read --$F_S$--.

Column 6, line 1 "$F_{S'}$" should read --$F_{B'}$--;
line 5, "$F_{S'}$" should read --$F_{B'}$--;

Column 8, line 9, "axis" should read --axes--.

Signed and Sealed this
First Day of April, 1997

Bruce Lehman

BRUCE LEHMAN
*Commissioner of Patents and Trademarks*

*Attest:*

*Attesting Officer*

UNITED STATES PATENT AND TRADEMARK OFFICE

CERTIFICATE OF CORRECTION

PATENT NO. : 5,547,354

DATED : August 20, 1996

INVENTOR(S) : Shimizu et al

It is certified that error appears in the above-indentified patent and that said Letters Patent is hereby corrected as shown below:

Column 7, line 14, "$O_2$" should read --$O_B$--.

Signed and Sealed this

Twenty-sixth Day of August, 1997

*Attest:*

Bruce Lehman

BRUCE LEHMAN

*Attesting Officer*

*Commissioner of Patents and Trademarks*